US006746280B1

(12) United States Patent
Lu et al.

(10) Patent No.: US 6,746,280 B1
(45) Date of Patent: Jun. 8, 2004

(54) SIGNAL ADAPTER FOR MEMORY CARD

(75) Inventors: Lien-Wan Lu, Tao-Yuan Hsien (TW); Chia-Li Chen, Yung Ho (TW)

(73) Assignees: Tai-Sol Electronics Co., Ltd., Taipei Hsien; Carry Computer Engineering Co., Ltd., Taipei Hsien ( * ) Notice: Subject to any disclaimer, the term of this patent is extended or adjusted under 35 U.S.C. 154(b) by 556 days.

(21) Appl. No.: 09/769,993

(22) Filed: Jan. 25, 2001

(51) Int. Cl.[7] ..... H01R 24/00

(52) U.S. Cl. ..... 439/630; 439/945; 439/946; 361/737

(58) Field of Search ..... 439/630, 631, 439/945, 946; 361/735, 737

(56) References Cited

U.S. PATENT DOCUMENTS

| | | | | | |
|---|---|---|---|---|---|
| 5,400,216 | A | * | 3/1995 | Tsai | 361/684 |
| 5,906,516 | A | * | 5/1999 | Sato et al. | 439/630 |
| 6,097,605 | A | * | 8/2000 | Klatt et al. | 361/737 |
| 6,250,965 | B1 | * | 6/2001 | Neifer | 439/630 |

* cited by examiner

*Primary Examiner*—Tho D. Ta

(57) ABSTRACT

A signal adapter for memory card serving as a signal bridge for transfer data between a memory card and a computer, etc, mainly comprise a base plate and an upper and a lower board, which enclose a plurality of overlapped slot space for receiving memory cards in different measurements. The signal adapter may be transplanting to a generic card reader to become a low-cost universal card reader for reading various memory cards.

5 Claims, 12 Drawing Sheets

SIGNAL ADAPTER FOR MEMORY CARD

FIELD OF THE INVENTION

This invention relates to an adapter, more particularly, it relates to a signal adapter, which serves as a universal signal communicator between a memory card of different measurements and a read/write machine.

BACKGROUND OF THE OF INVENTION

"Memory" is undoubted an indispensable element in todays various electronic devices, such as home computer, notebook computer, personal digital assistant (PDA), digital camera, business machine, etc, and "bigger capacity with smaller volume" seems always a motto that spurs and urges every maker in this competitive field. Now, we a have a name-card sized memory card tat can store data more than 64 MB, for example, the Multi Media Card, the Smart Media Card, the Memory Stick Card, etc.

A card reader is needed for reading the stored data in such a memory card as shown in FIG. 1, wherein a memory card (C) is supposed to be plugged in a PCMCIA (Personal Computer Memory Card International Association) regulated plugging interface (A) to thereby couple indirectly with a machine terminal (B) (a notebook computer in this instance). Another example shown in FIG. 2 is to plug the memory card (C) in an eternal card reader (D) via an optimum interface (not shown) for reading data.

In whichever of the abovesaid examples, either through the PCMCIA plugging interface (A) in FIG. 1 or the card reader (D) in FIG. 2, only one of the mentioned memory cards is permitted to be inserted and read, otherwise, a plurality of plugging interfaces or card reader must be prepared for overcoming the problem of incompatibility of memory card that would entail an extra else.

SUMMARY OF THE INVENTION

In order to curtail the extra expense, the primary object of this invention is to provide a signal adapter for memory card comprising a base plate, an upper board, and a lower board to enclose different slot spaces for plugging memory card in different sizes. The slot spaces are overlapped and communicable to each other that can provide different spaces for fitting different memory cards without needing to purchase more PCMCIA plugging interfaces or card readers.

For more detailed information regarding this invention together with further advantages or features thereof, at least an example of preferred embodiment will be elucidated below with reference to the annexed drawings.

BRIEF DESCRIPTION OF THE DRAWINGS

The related drawings in connection with the detailed description of this invention, which is to be made later, are described briefly as follows, in which.

DETAILED DESCRIPTION OF THE PREFERRED EMBODIMENT

Figure 1:
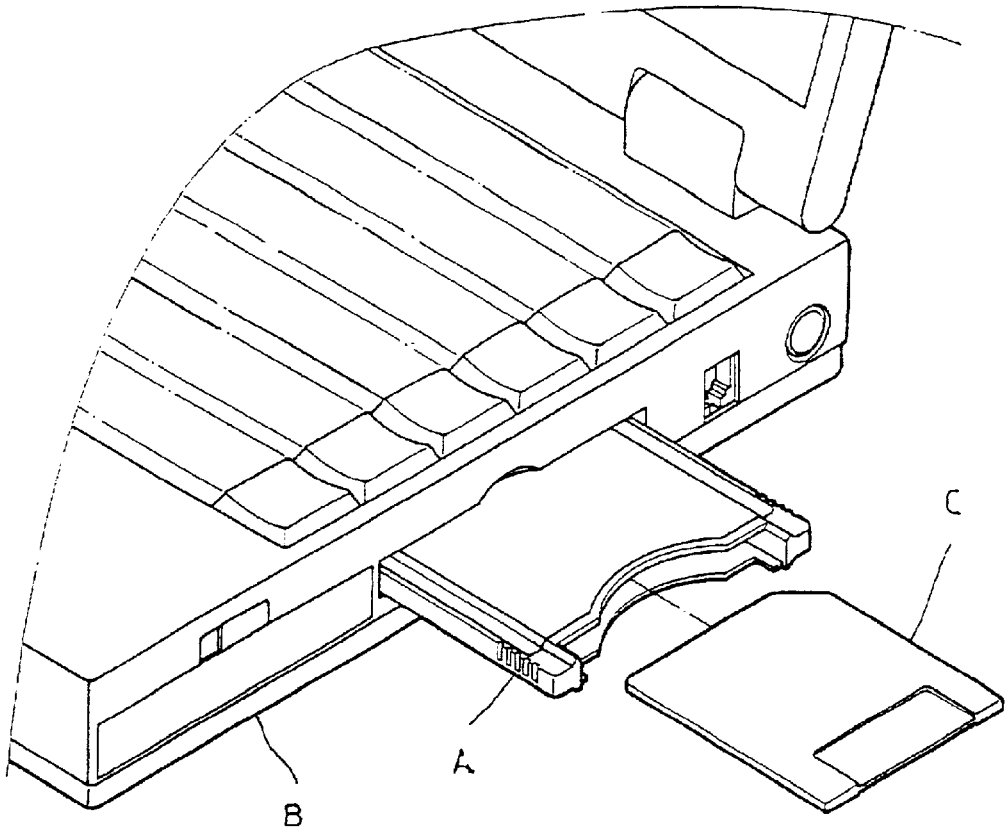
FIG. 1 shows a communication mode of plugging a conventional memory card (C) in a machine terminal (B) through a PCMCIA adapter interface (A)
Figure 2:
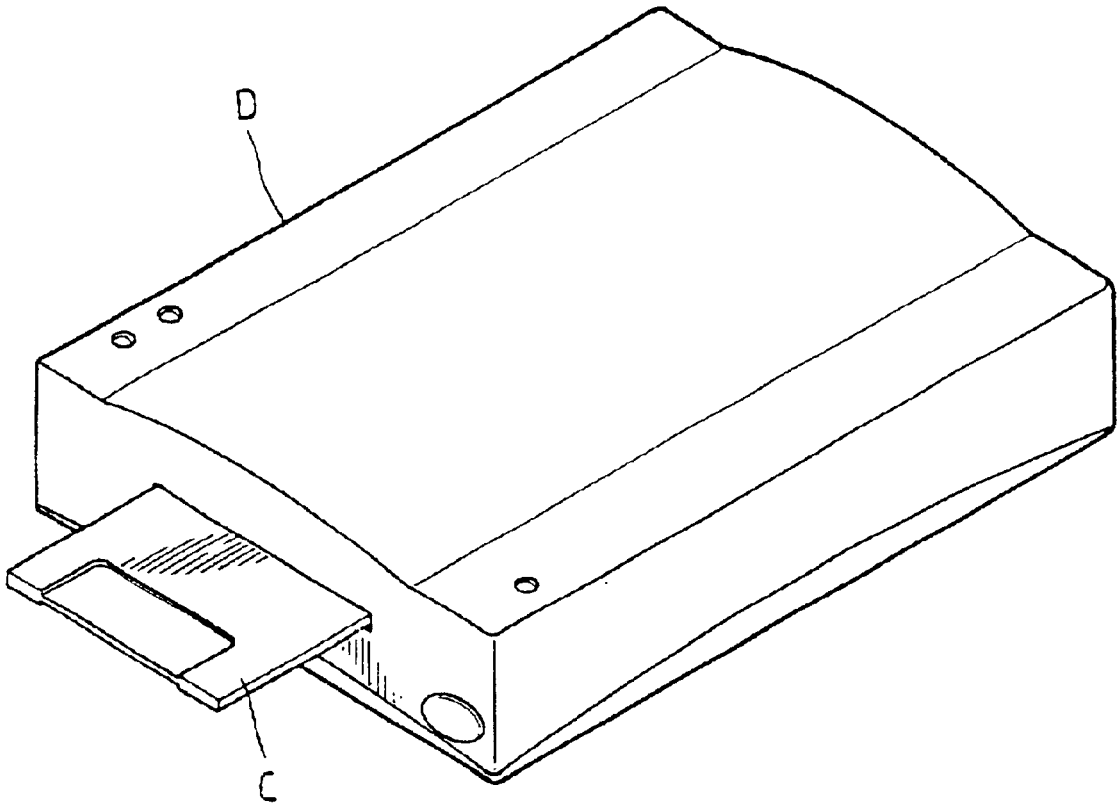
FIG. 2 is a schematic view showing that the memory card (C) is plugged in a card reader(D)
Figure 3:
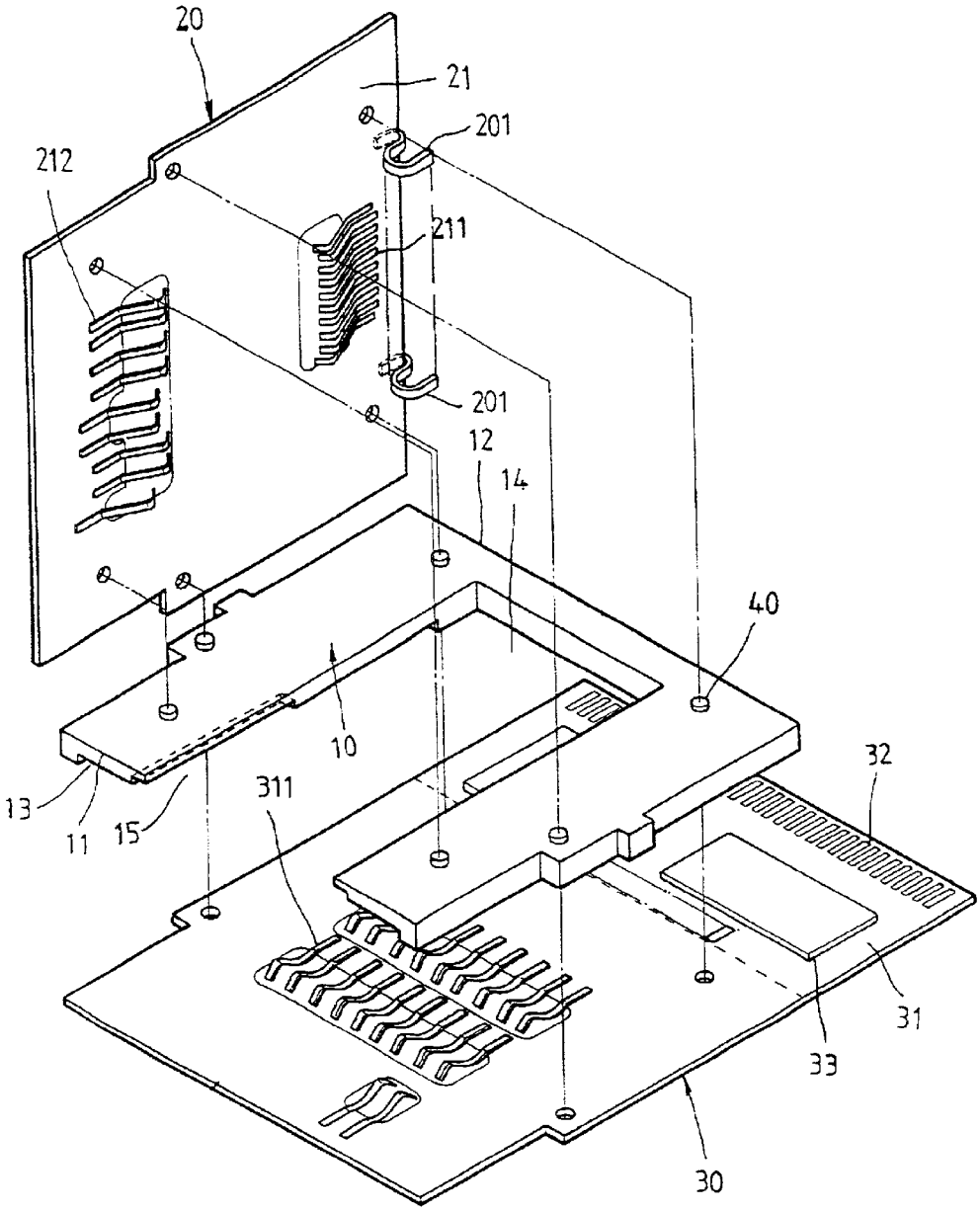
FIG. 3 is an exploded view of this invention.
Figure 4:
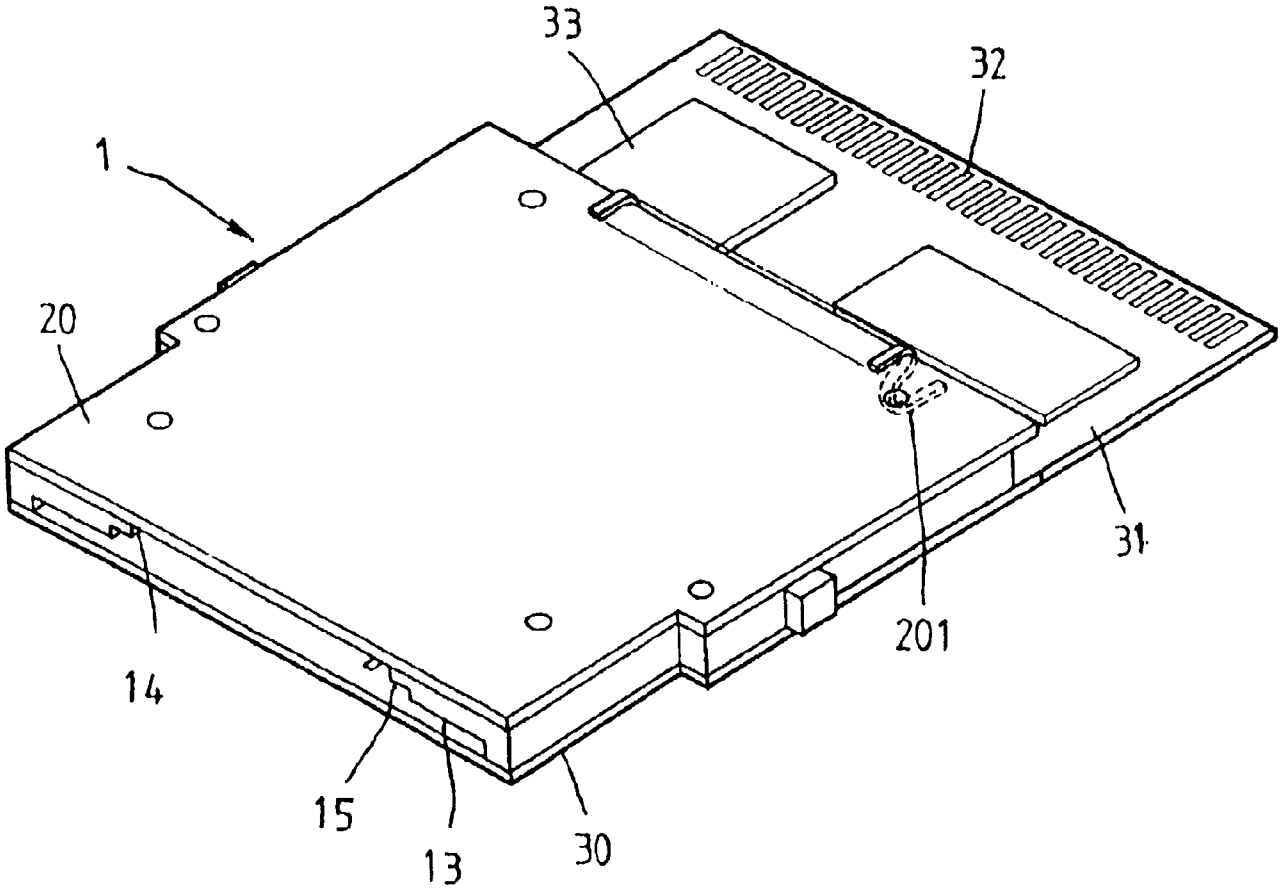
FIG. 4 is an assembled elevational view of FIG. 3.

As indicated in FIGS. 3 and 4, a signal adapter for memory card of this invention mainly comprises a base plate 10, an upper board 20, and a lower board 30.

In the base plate 10, a plurality of slot-spaces 13, 14, 15 for accommodating various memory cards in different measurements is extended from an open end 11 toward the other end 12.

A plurality of contact terminals is soldered on the upper and the lower board 20, 30 including a fist set of contact terminals 211 and a second set of contact terminals 212 on a downward surface of the upper board 20, and a third set of contact terminals 311 on an upward surface of the lower board 30 for transmitting data of an inserted memory card Moreover, a plurality of conductive elements 201 is arranged between those upper and lower boards for signal coupling. An auxiliary plate 31 is disposed on one of the boards (the lower board 30 in this case) at a father end from the memory card entrance, wherein a plurality of contacts 32 for connecting with a machine terminal is aligned on a terminal surfing of the auxiliary plate 31 to enable the machine terminal to read/write data from or to an inserted memory card Meanwhile, several logic-control ICs 33 are disposed on the auxiliary plate 31 for controlling signal's convention or flow directions.

Figure 12:
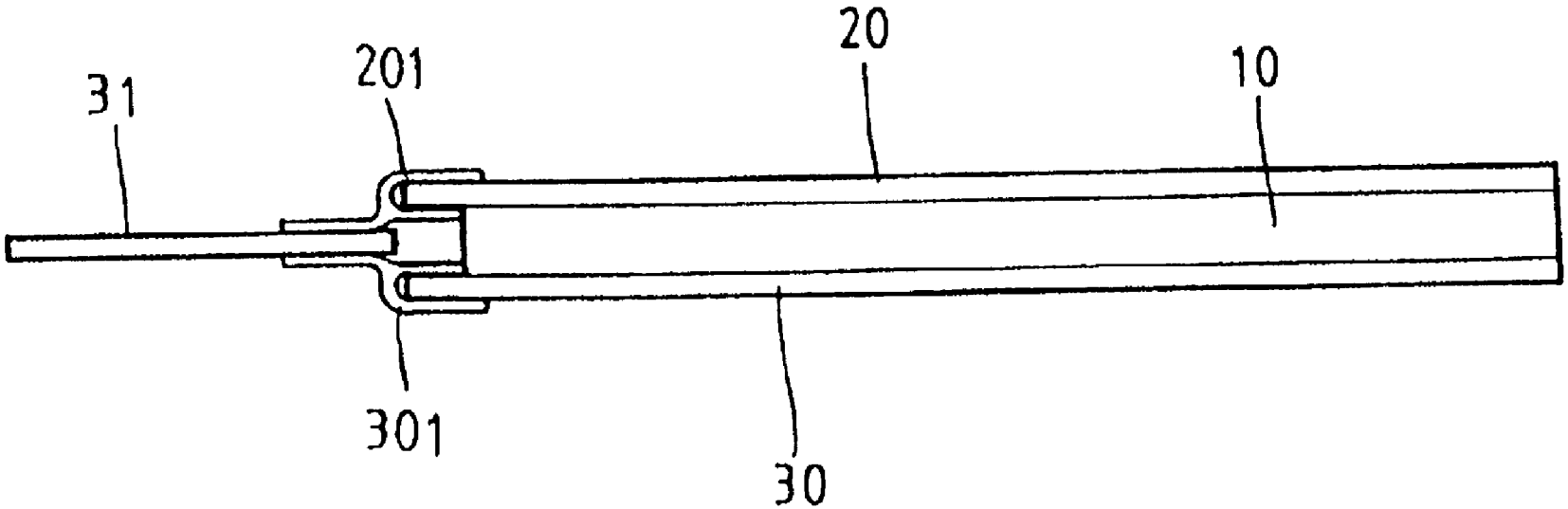
FIG. 12 is a structural side view showing that an auxiliary plate is connected with an upper and a lower board of this invention.

In the embodiment above, the auxiliary plate 31 and the lower board 30 are made integrally and conducively jointed through respective electronic circuits. However, this design may be altered slightly by laying the auxiliary plate 31 between the upper and the lower board 20, 30 and connected therewith through respective conductive elements 201, 301 as shown in FIG. 12 for data transfer of an inserted a memory card.

Figure 5:
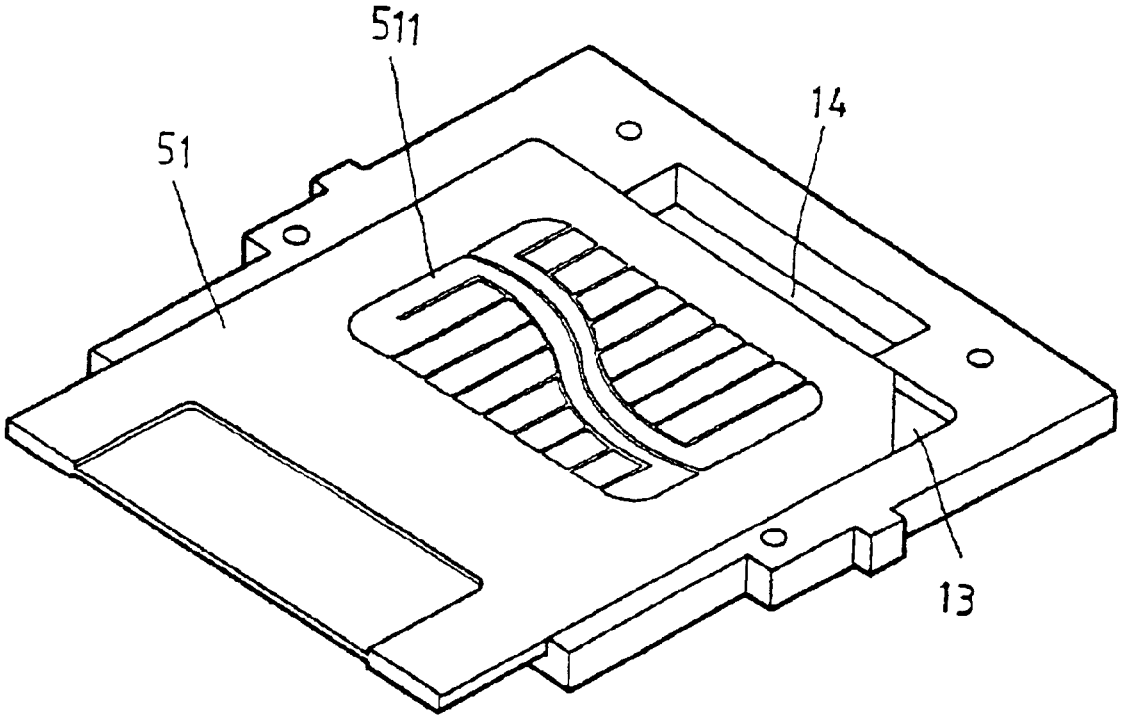
FIG. 5 shows an embodiment of plugging a Smart Media Card in the base plate of this invention.
Figure 8:
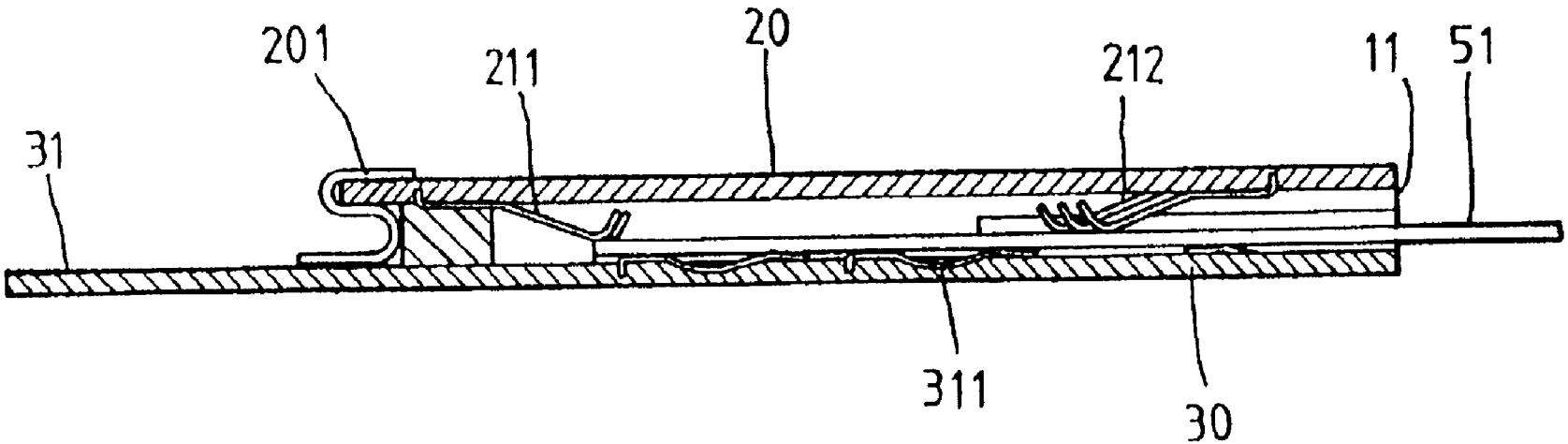
FIG. 8 is a structural side view of the plugged Smart Media Card and the base plate of this invention.

The mentioned base plate 10 and the boards 20, 30 are combined together with positioning plugs 40 to build a flat box as shown in FIG. 4, wherein a multiple-slot channel is formed serving as the slot spaces 13, 14, 15 for loading memory cards in different sizes. In FIG. 5 for instance, a Smart Media Card 51 is inserted in an upside-down reversed base plate 10 shown in FIG. 3 (for showing relative position of the card to the slot space 13 more clearly), and inside the flat box, a plurality of contacts 511 on the Smart Media Card 51 is in contact with the prelocated third set of contact terminals 311 on the lower board 30 shown in FIG. 8 so as to communicate the memory card with a machine terminal through a signal adapter 1.

Figure 6:
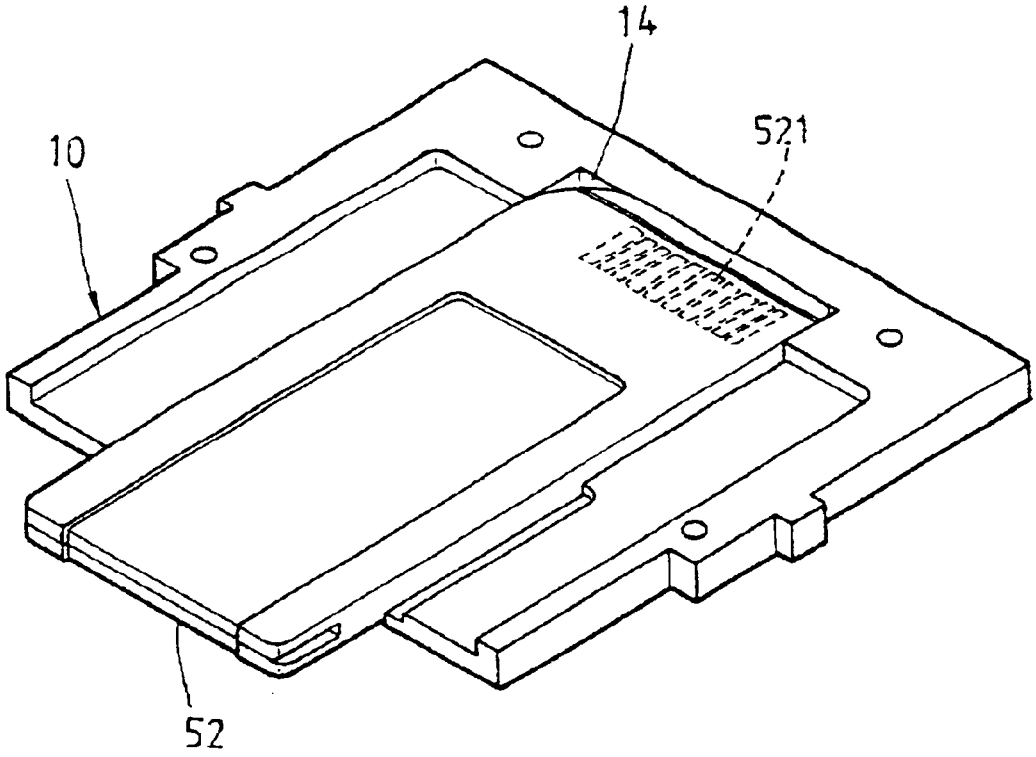
FIG. 6 shows an embodiment of plugging a Memory Stick Card in the base plate of this invention.

FIG. 6 illustrates a Memory Stick Card 52 being plugged in the slot space 14 of the base plate 10, wherein the slot space 14 is viewed overlapping part of the slot space 13. In such a way by slot-space variation of the base plate 10, the signal adapter 1 obviously needs only a wider and deeper slot space for receiving memory cards in different size instead of two or three. Besides, one set of contacts 521 is also disposed on the Memory Stick Card 52 for contact with the first set of contact terminals 211 on the upper board 20.

Figure 7:
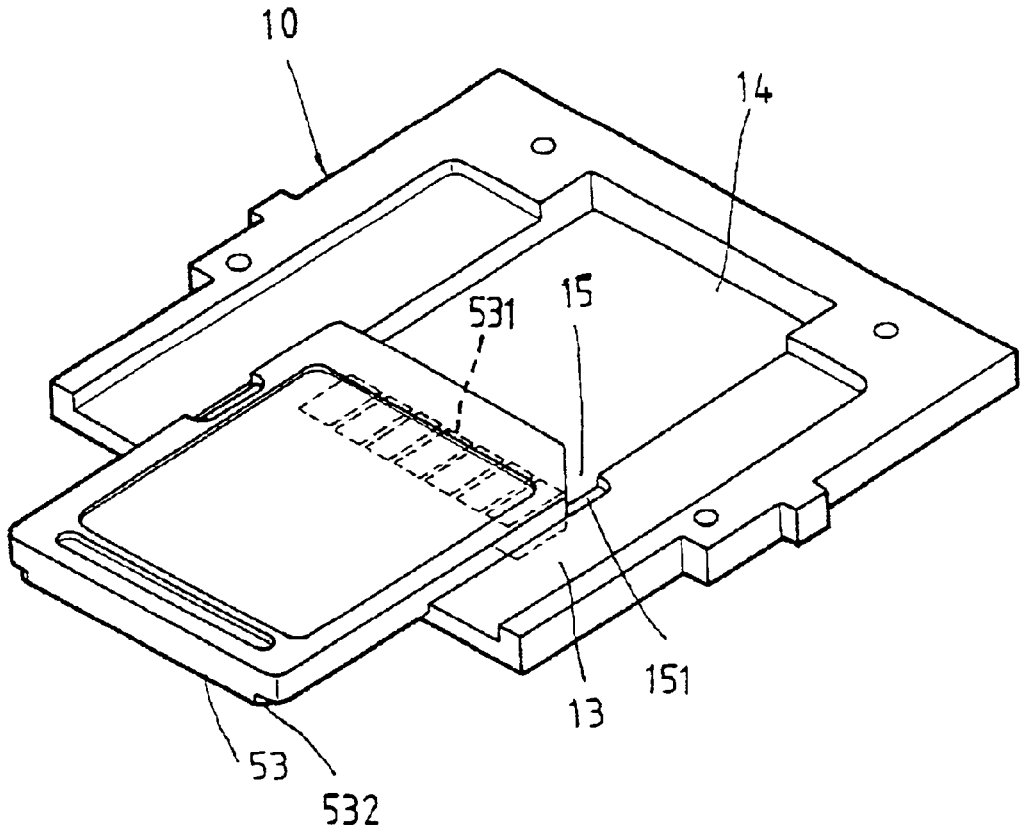
FIG. 7 shows an embodiment of plugging a Multi Media Card in the base plate of this invention.

Similarly, a Multi Media Card 53 is en route plugged in or pulled from the base plate 10 along a slot space 15 shown in FIG. 7. Because the Multi Media Card 53 is relatively shorter and slightly wider in comparison with the Memory Stick Card 52, the slot space 15 is therefore arranged at the front half of the slot space 14, which is reamed on both sides to form respective ladder portions 151 for fitting recess portions 532 of the Multi Media Card 53. And, a set of contacts 531 is disposed on the Multi Media Card 53 for contact with the second set of contact terminals 212 of the upper board 20 after the Multi Media Card 53 is plugged in the signal adapter 1.

Figure 9:
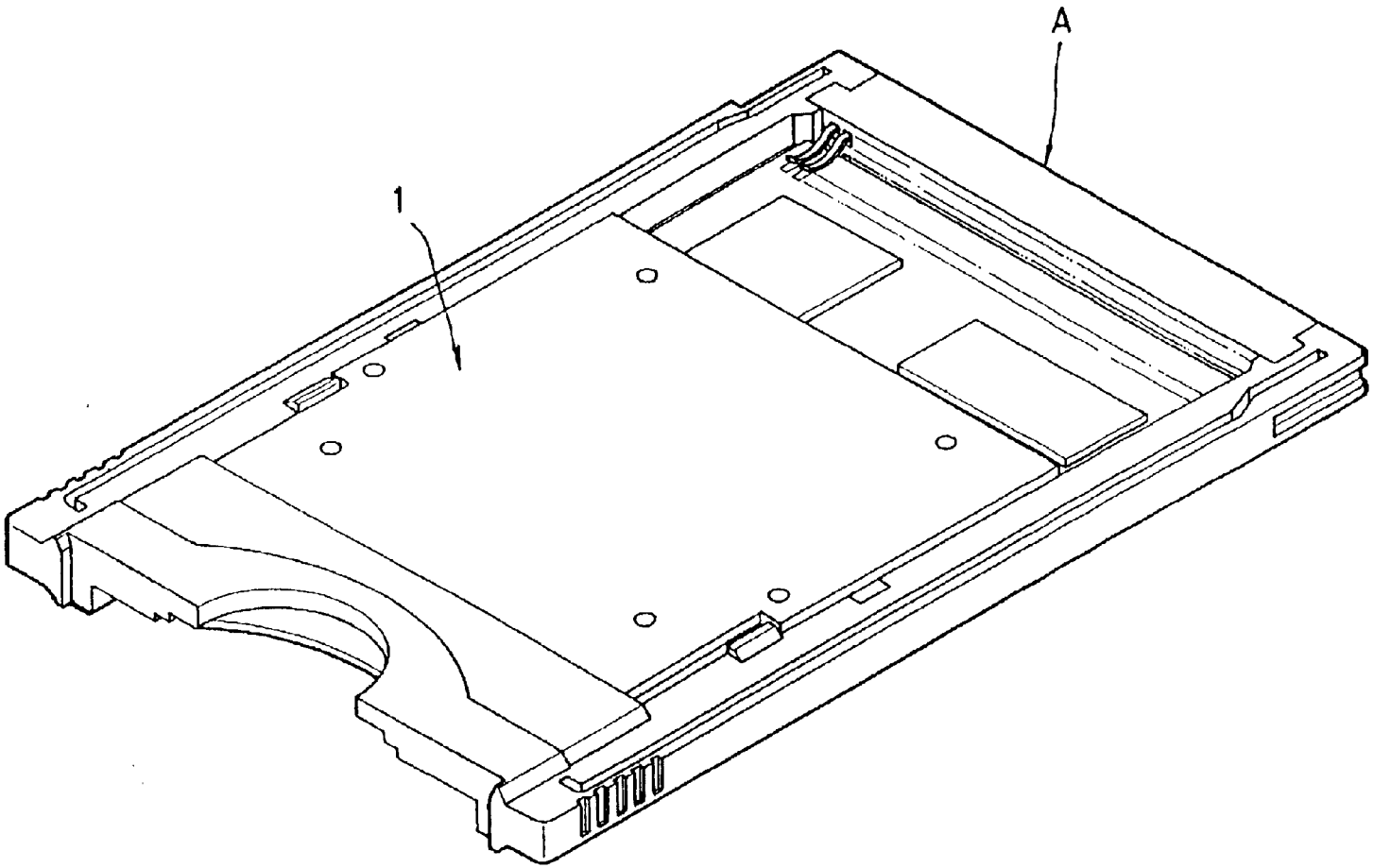
FIG. 9 shows this invention being installed in the PCMCIA adapter interface.
Figure 10:
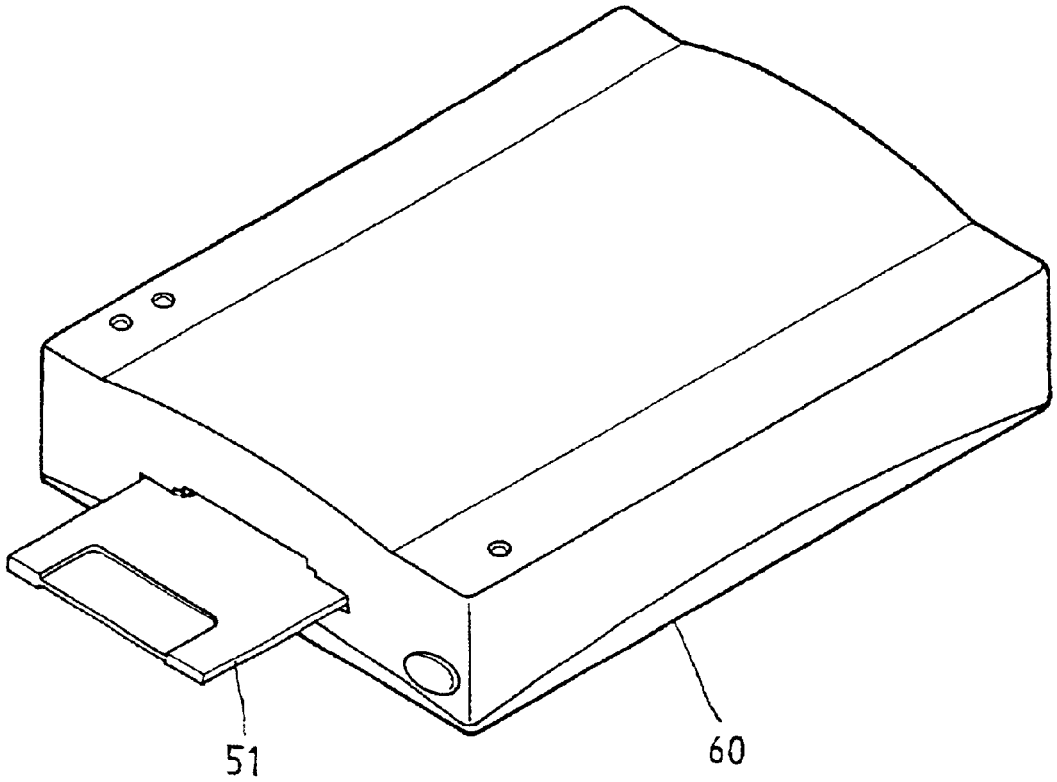
FIG. 10 shows this invention being installed in an external card-reader.
Figure 11:
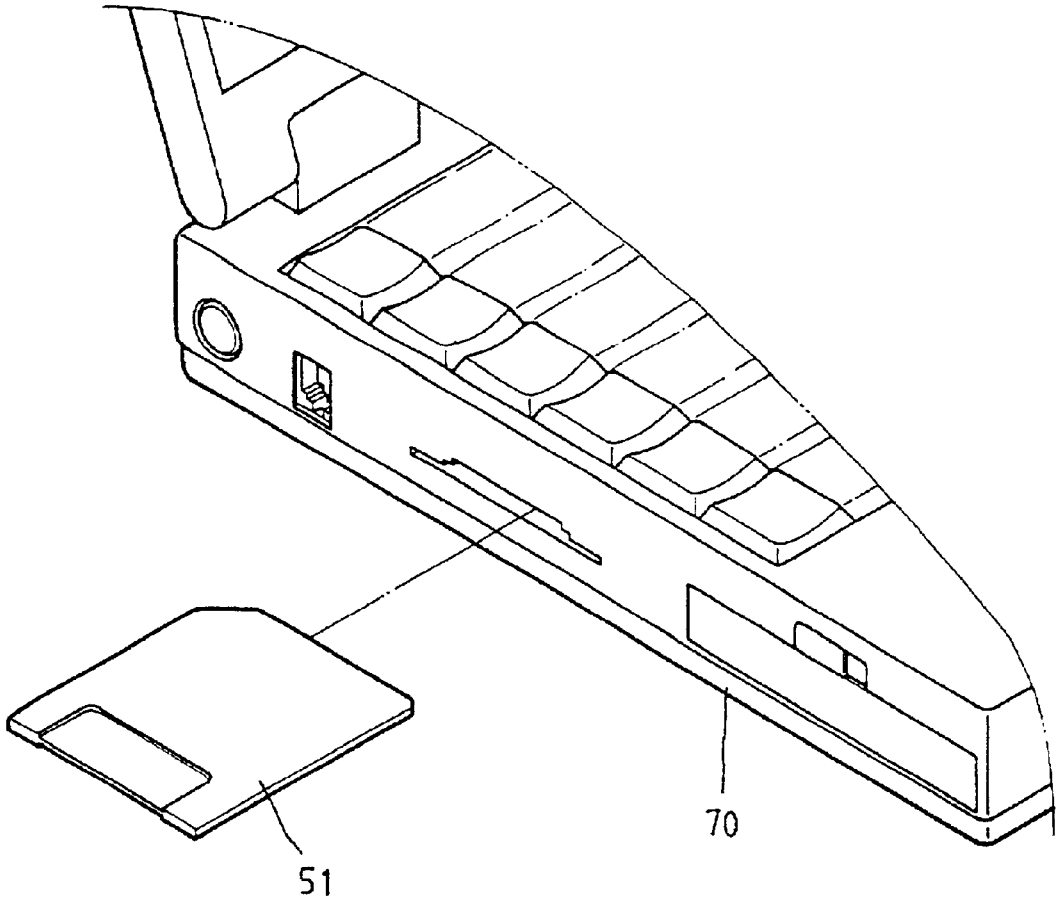
FIG. 11 shows this invention being applied in a computer.

From FIGS. 5–7, it can be seen that in order to support memory cads of different sizes stably and reliably, the base plate 10 hat a multi-step structure. A channel with specific width and length is formed at each step structure for receiving a memory card of a specific size. In addition, the signal adapter 1 for memory card of this invention may be built in a conventional PCMCIA plugging interface (A) shown in FIG. 9 for reading different memory cards in different types, or in a card reader 60 shown in FIG. 10, or a computer 70 shown in FIG. 11 to realize a low cost universal card reader.

In the above described, at least one preferred embodiment has been elucidated with reference to the drawings annexed, and it is apparent that numerous variations or modifications may be made without departing from the true spirit and scope thereof, as set forth in the claims below.

What is claimed is:

1. A signal adapter for memory card, comprising:

an upper board;

a base plate being extended horizontally from one end where a memory card enters to an opposite end, and comprising a plurality of overlapped channels for accommodating memory cards in different measurements said base plate having a multi-step structure in which each step structure is formed with a channel of specific width, height and length for receiving a memory card of a specific size; and a lower board;

wherein electronic circuits are disposed on the base plate: a plurality of conductive terminals is arranged between those upper and lower boards for signal coupling; a plurality of contact terminals is soldered to the boards on respective surfaces facing the base plate for contact with an inserted memory card; and a plurality of overlapped slot spaces is naturally formed for signal transfer when the base plate and the upper and lower boards are combined together.

2. The signal adapter according to claim 1, wherein an auxiliary plate is coupled to one of the boards via a conductive element at a farther end opposite to a memory card entrance, and a plurality of contacts and control ICs are disposed on the auxiliary plate for conductively jointing with an external interface or a machine terminal.

3. The signal adapter according to claim 1, wherein an auxiliary plate is coupled to each board respectively via a conductive element at a farther end opposite to a memory card entrance, and a plurality of contacts and control ICs are disposed on the auxiliary plates for conductively jointing with an external interface or a machine terminal.

4. The signal adapter according to claim 1, wherein a plurality of contacts and control ICs arc disposed on the base plate at a farther end opposite to a memory card entrance for conductivey jointing with an external interface or a machine terminal.

5. The signal adapter according to claim 4, wherein an auxiliary plate is coupled to one of the boards via a conductive element at a farther end opposite to a memory card entrance, and a plurality of contacts and control ICs are disposed on the auxiliary plate for conductively jointing with an external interface or a machine terminal.

* * * * *